US011713931B2

(12) United States Patent
Mercer

(10) Patent No.: US 11,713,931 B2
(45) Date of Patent: Aug. 1, 2023

(54) MULTICHANNEL EVAPORATOR DISTRIBUTOR

(71) Applicant: Carrier Corporation, Palm Beach Gardens, FL (US)

(72) Inventor: Kevin Mercer, Danville, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 121 days.

(21) Appl. No.: 16/860,236

(22) Filed: Apr. 28, 2020

(65) Prior Publication Data

US 2020/0348091 A1 Nov. 5, 2020

Related U.S. Application Data

(60) Provisional application No. 62/842,183, filed on May 2, 2019.

(51) Int. Cl.

| | |
|---|---|
| ***F28F 9/02*** | (2006.01) |
| ***F25B 39/02*** | (2006.01) |
| *F28D 21/00* | (2006.01) |

(52) U.S. Cl.

CPC ..... *F28F 9/0273* (2013.01); *F25B 39/028* (2013.01); *F28D 2021/0071* (2013.01)

(58) Field of Classification Search

CPC . F28F 9/02; F28F 9/0273; F28F 9/026; F28D 2021/0071; F28D 2021/0085; F28D 9/0043; F28D 9/005; F28D 9/0056; F25B 39/028

See application file for complete search history.

(56) References Cited

U.S. PATENT DOCUMENTS

| | | | |
|---|---|---|---|
| 5,836,382 | A | 11/1998 | Dingle et al. |
| 6,016,864 | A | 1/2000 | Bae et al. |
| 6,745,827 | B2 | 6/2004 | Lee et al. |
| 7,059,396 | B2 | 6/2006 | Foli |
| 7,143,605 | B2 | 12/2006 | Rohrer et al. |
| 7,967,060 | B2 | 6/2011 | Trumbower et al. |
| 8,235,101 | B2 | 8/2012 | Taras et al. |
| 8,474,516 | B2 | 7/2013 | Valenzuela |
| 8,662,148 | B2 | 3/2014 | Wand |
| 9,291,407 | B2 | 3/2016 | Huazhao et al. |
| 9,459,057 | B2 | 10/2016 | Wand et al. |
| 9,528,778 | B2 | 12/2016 | Liu |
| 9,696,095 | B2 | 7/2017 | Lee et al. |
| 9,989,283 | B2 | 6/2018 | Alahyari et al. |
| 10,048,024 | B1 | 8/2018 | Sole et al. |

(Continued)

FOREIGN PATENT DOCUMENTS

| | | | |
|---|---|---|---|
| CN | 101788212 | B | 4/2012 |
| CN | 202254500 | U | 5/2012 |

(Continued)

*Primary Examiner* — Harry E Arant

(74) *Attorney, Agent, or Firm* — Cantor Colburn LLP

(57) ABSTRACT

A distributor for use in a heat exchanger including a distributor body having a first end, a second end, and a hollow interior. A fluid inlet is formed at the first end and a fluid outlet includes a plurality of orifices formed in the distributor body. The fluid outlet is configured to achieve a ratio of a pressure drop across the distributor to a pressure drop across the heat exchanger between about 3 and about 7 at nominal refrigerant flowrate conditions.

8 Claims, 5 Drawing Sheets

(56) References Cited

U.S. PATENT DOCUMENTS

2002/0174978 A1* 11/2002 Beddome ..... F28D 9/0043 165/906
2010/0089559 A1* 4/2010 Gorbounov ..... F25B 39/028 165/174
2010/0242535 A1* 9/2010 Jianlong ..... F25B 39/028 62/524
2011/0127023 A1* 6/2011 Taras ..... F25B 39/028 165/173
2011/0240276 A1* 10/2011 Wintersteen ..... F28D 1/05383 165/173
2011/0290465 A1* 12/2011 Joshi ..... F28F 9/0273 165/175
2014/0202673 A1* 7/2014 Wand ..... F28D 1/05383 165/175
2015/0122470 A1* 5/2015 Xia ..... F28F 9/0273 165/174
2017/0227266 A1 8/2017 Winters et al.
2018/0073809 A1 3/2018 Seo et al.

FOREIGN PATENT DOCUMENTS

CN 102141326 B 7/2013
CN 105371537 A 3/2016
CN 105180518 B 9/2018
CN 109099615 A 12/2018
CN 105299966 B 1/2019
CN 208382637 U 1/2019
EP 2079974 A2 7/2009
EP 2236973 A2 6/2010
EP 1844288 B1 10/2011
EP 3252421 A1 * 12/2017 ..... F28F 9/001

* cited by examiner

MULTICHANNEL EVAPORATOR DISTRIBUTOR

CROSS-REFERENCE TO RELATED APPLICATIONS

This application claims the benefit of U.S. Provisional Application No. 62/842,183 filed May 2, 2019, the disclosure of which is incorporated herein by reference in its entirety.

BACKGROUND

Embodiments of the present disclosure relate generally to heat exchangers and more particularly, to providing a more uniform distribution of liquid refrigerant amongst a plurality of parallel fluid conveying passages of a parallel flow or counter flow heat exchanger.

Parallel or counter flow heat exchangers include a plurality of spaced parallel passages for conveying a first fluid in heat exchange relationship with a second fluid. A type of parallel flow heat exchanger commonly used as refrigerant evaporators, condensers, and gas coolers in refrigeration and air conditioning applications, as well as used as fluid heating and cooling heat exchangers in other applications, includes a plurality of tubes defining the fluid conveying passages. The tubes are disposed in spaced parallel relationship and open into a common manifold for receiving fluid. Typically, it is desirable that each tube, and even channel for multi-channel tubes receive an equal flow of liquid. However, conventional parallel flow heat exchangers, in particular parallel flow heat exchangers having multi-channel tubes, such as mini-channel or micro-channel tubes, suffer from liquid maldistribution, that is from a lack of uniformity in the amount of liquid distributed to each individual multi-channel tube.

Flow maldistribution is particularly problematic in applications where a two-phase fluid is delivered to the fluid chamber of the manifold for distribution amongst an aligned array of the plurality of tubes opening into the fluid chamber of the manifold at spaced intervals along the length of the manifold. For example, in a conventional refrigeration/air conditioning cycle, refrigerant is expanded through an expansion valve from high to low pressure and then delivered into the manifold of the evaporator as a two-phase, low pressure mixture of refrigerant vapor and refrigerant liquid. It is generally accepted that flow maldistribution in two-phase flow heat exchangers may primarily be attributed to the difference in densities of liquid phase and the vapor phase. Additionally, gravity forces may separate the liquid and vapor phases as the two-phase mixture passes along the length of the manifold.

BRIEF DESCRIPTION

According to an embodiment, a distributor for use in a heat exchanger including a distributor body having a first end, a second end, and a hollow interior. A fluid inlet is formed at the first end and a fluid outlet includes a plurality of orifices formed in the distributor body. The fluid outlet is configured to achieve a ratio of a pressure drop across the distributor to a pressure drop across the heat exchanger between about 3 and about 7 at nominal refrigerant flowrate conditions.

In addition to one or more of the features described above, or as an alternative, in further embodiments the ratio of a pressure drop across the distributor to a pressure drop across the heat exchanger is between about 3 and about 5.

In addition to one or more of the features described above, or as an alternative, in further embodiments the distributor body is generally tubular in shape and has a uniform, generally circular cross-section over its length.

In addition to one or more of the features described above, or as an alternative, in further embodiments an axial length of the distributor body is between about 16 inches and 20 inches.

In addition to one or more of the features described above, or as an alternative, in further embodiments an inner diameter of the tubular body is less than ½ inch.

In addition to one or more of the features described above, or as an alternative, in further embodiments at least one of the plurality of orifices is skewed about a periphery of the distributor body.

In addition to one or more of the features described above, or as an alternative, in further embodiments each of the plurality of orifices is substantially uniform in size and shape.

In addition to one or more of the features described above, or as an alternative, in further embodiments a diameter of each of the plurality of orifices is between 1.2 mm and 1.4 mm.

According to another embodiment, a heat exchanger includes a liquid distribution manifold, a fluid collection manifold, and a plurality of parallel heat exchanger tubes fluidly connecting the liquid distribution manifold and the fluid collection manifold. The plurality of heat exchanger tubes includes a plurality of active tubes. A distributor is arranged within the liquid distribution manifold. The distributor includes a distributor body having a first end, a second end, and a hollow interior. A fluid inlet is formed at the first end and a fluid outlet includes a plurality of orifices formed in the distributor body. The orifice of the plurality of orifices located closest to the fluid inlet is substantially aligned with one of the plurality of active tubes.

In addition to one or more of the features described above, or as an alternative, in further embodiments the plurality of active tubes includes at least a first active tube directly adjacent the first inactive tube, a second active tube, a third active tube and a fourth active tube.

In addition to one or more of the features described above, or as an alternative, in further embodiments the orifice is substantially aligned with one of the second active tube, the third active tube, and the fourth active tube.

In addition to one or more of the features described above, or as an alternative, in further embodiments the orifice is substantially aligned with the first active tube.

In addition to one or more of the features described above, or as an alternative, in further embodiments the fluid outlet being configured to achieve a ratio of a pressure drop across the distributor to a pressure drop across the heat exchanger between about 3 and about 7 at nominal refrigerant flowrate conditions.

In addition to one or more of the features described above, or as an alternative, in further embodiments the plurality of orifices are arranged linearly along the distributor body.

In addition to one or more of the features described above, or as an alternative, in further embodiments at least one of the plurality of orifices is skewed about a periphery of the distributor body.

In addition to one or more of the features described above, or as an alternative, in further embodiments each of the plurality of orifices is substantially uniform in size and shape.

According to another embodiment, a method of designing a distributor for a heat exchanger of a residential heating ventilation and air conditioning system includes determining a number of orifices to form in a distributor body to achieve a ratio of a pressure drop across the distributor to a pressure drop across the heat exchanger between about 3 and about 7 at nominal refrigerant flowrate conditions, determining a spacing between the orifices, a first orifice being positioned in alignment with an active tube of the heat exchanger, collecting thermal images of a fluid flow through the heat exchanger when a distributor having the determined number of orifices and the determined spacing between the orifices is associated with a liquid distribution manifold of the heat exchanger, and determining which, if any, of the orifices to eliminate based on the thermal images from the outlet portion of the heat exchanger.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
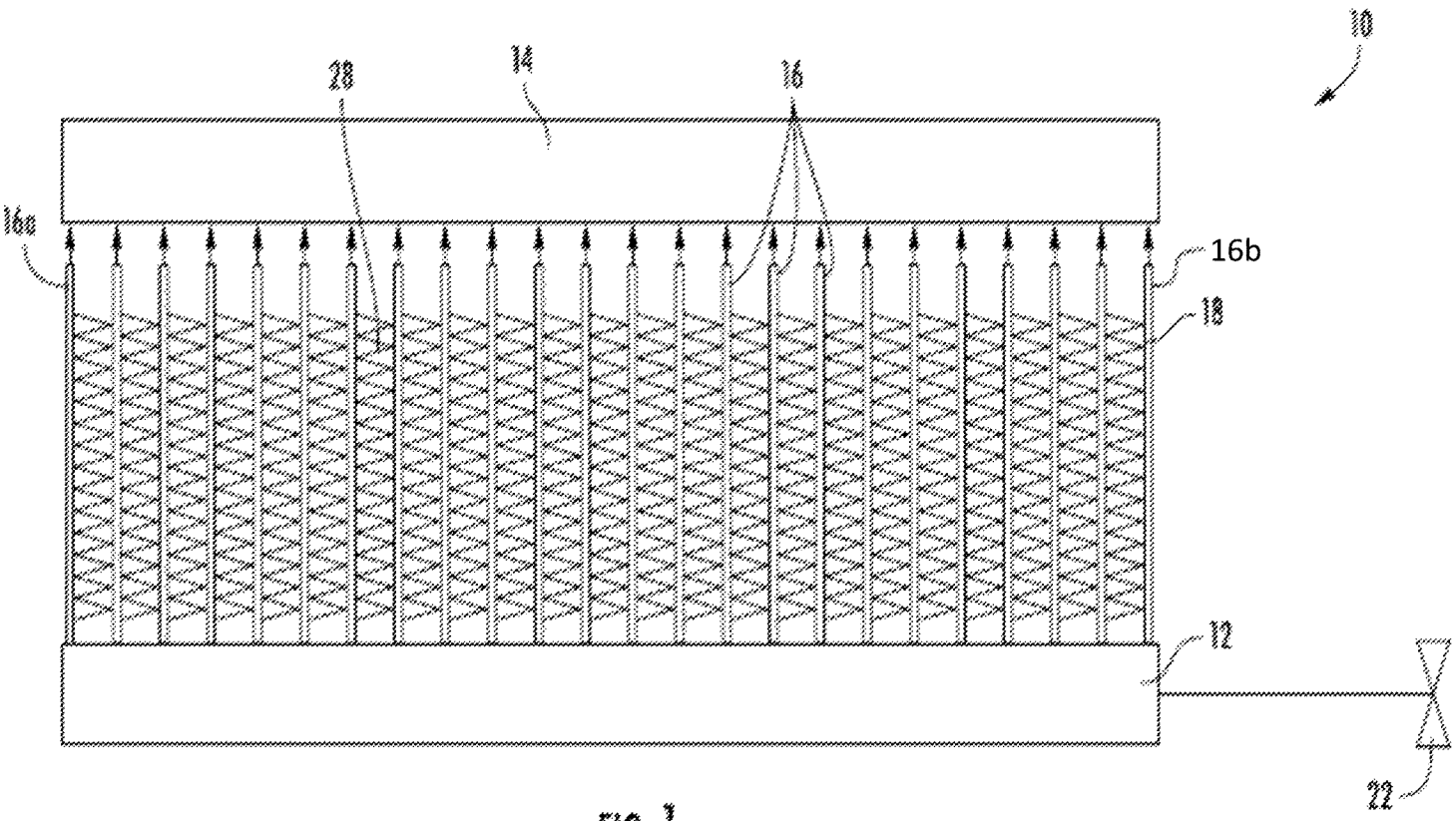
FIG. 1 is a front view of an example of a heat exchanger.

Referring now to FIG. 1, an example of a parallel flow heat exchanger is illustrated at 10. The heat exchanger 10 includes a first header or fluid distribution manifold 12, a second header or fluid collection manifold 14, and a plurality of parallel, longitudinally spaced heat exchanger tubes 16 extending between the first header 12 and the second header 14. Each of the heat exchanger tubes 16 defines one or more parallel heat exchanger flow passages 18 opening into the respective interior chamber of the first header 12 and the second header 14 for conveying fluid from the first header 12 to the second header 14. In the illustrated, non-limiting embodiment, the heat exchanger tubes 16 includes a flattened microchannel heat exchanger tube 16 having a leading edge 23, a trailing edge 24, a first surface 25, and a second surface 26. The leading edge of the heat exchange tube is arranged upstream of its respective trailing edge with respect to an airflow passing through the heat exchanger. The interior flow passage of each heat exchanger tube may be divided by interior walls into a plurality of discrete flow channels that extend over the length of the tubes from an inlet end to an outlet end and establish fluid communication between the respective first and second manifolds. The flow channels may have a circular, rectangular, trapezoidal, or triangular cross-section, or another non-circular cross-section. The heat exchanger tubes including the discrete flow channels may be formed using known techniques and materials, including, but not limited to, extruded or folded.

Microchannel and minichannel tubes differ only by channel size, i.e. the hydraulic diameter of the channel. The term multichannel heat exchanger refers to both minichannel and microchannel heat exchangers. However, it should be understood that any type of heat exchanger tube 16, including a heat exchanger tube having only a single flow passage 18 is also within the scope of the disclosure. Further, a plurality of fins 28 may be disposed between adjacent heat exchanger tubes 16 as shown in the FIGS.

Figure 2:
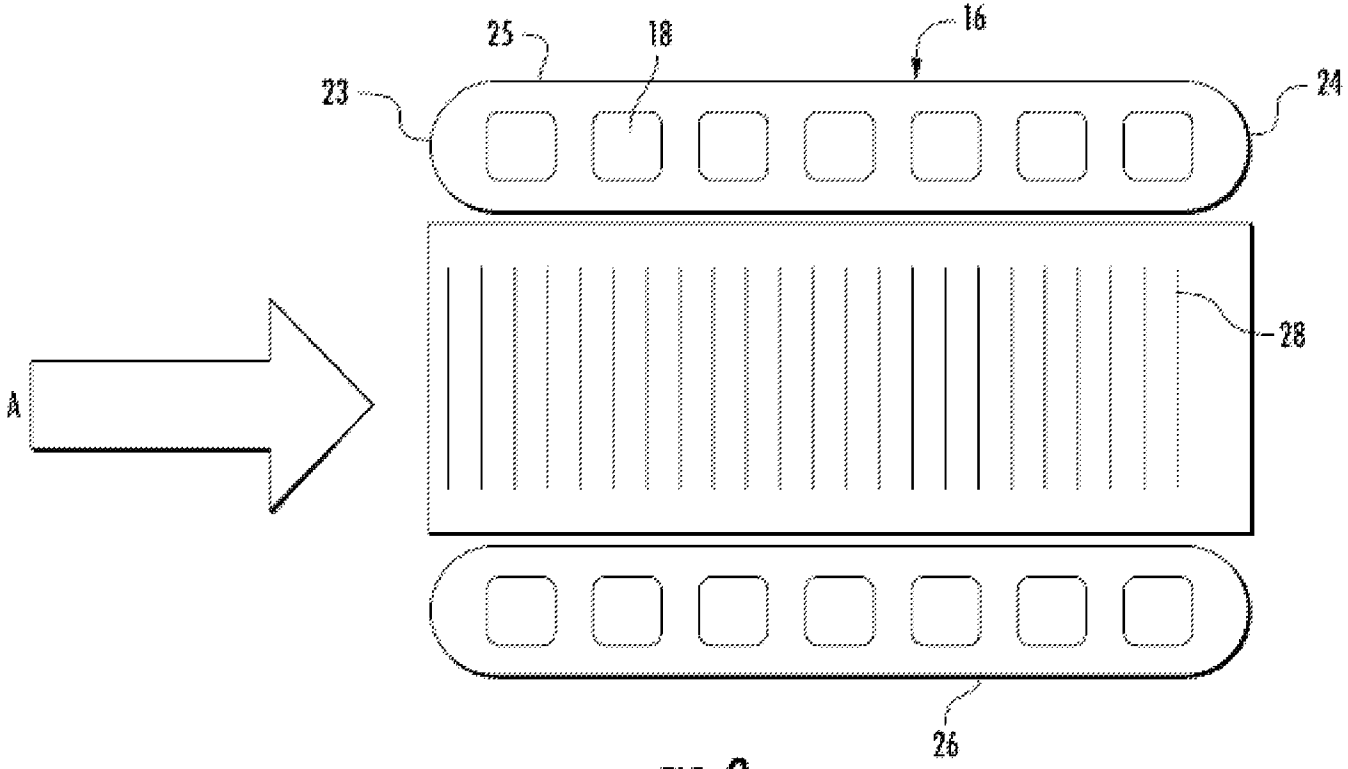
FIG. 2 is a cross-sectional view of an example of a heat exchanger tube of the heat exchanger of FIG. 1.
Figure 3:
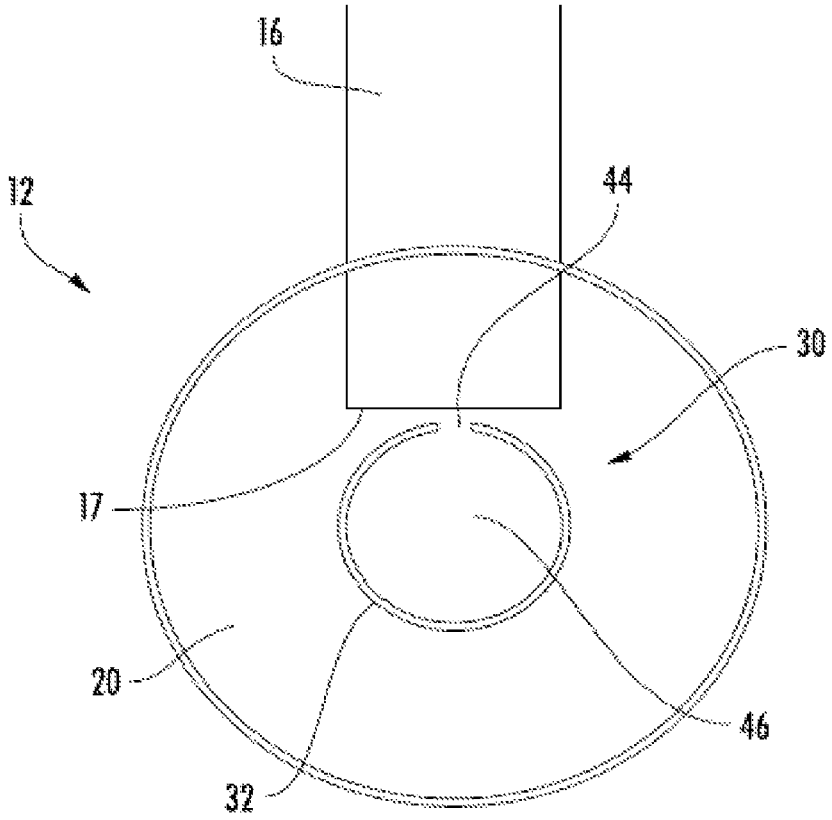
FIG. 3 is a cross-sectional view of an interior of a first manifold of a heat exchanger including a distributor according to an embodiment.

The heat exchanger 10 as described herein may be configured as an evaporator heat exchanger in a direct expansion refrigeration system including a compressor, a condenser, an expansion device, and an evaporator. In such embodiments, a fluid, such as refrigerant F for example, flowing through the heating, ventilation, air conditioning, and refrigeration (HVAC&R) system passes in heat exchange relationship with a heating fluid, such as air to be cooled for example, within the heat exchanger 10. The heat transferred from the heating fluid to the refrigerant F causes the refrigerant F to vaporize as the refrigerant traverses the heat exchanger 10. Prior to entering into the interior chamber 20 (see FIG. 2) of the first header 12, the refrigerant passes through an expansion device 22, such as a thermostatic expansion valve for example, which causes the refrigerant F to expand from a high pressure liquid to a lower pressure two-phase mixture of refrigerant liquid and refrigerant vapor.

A distributor 30 may be provided within the hollow interior chamber 20 of the fluid distribution manifold 12. The distributor 30 is configured to distribute the liquid provided to the interior chamber 20 of the fluid distribution manifold 12 amongst the plurality of parallel flow passages 18 of the plurality of heat exchanger tubes 16. Inclusion of the distributor 30 is intended to more uniformly distribute the liquid portion of the two-phase mixture refrigerant F, thereby minimizing liquid maldistribution across the fluid distribution manifold 12.

Residential HVAC&R applications typically include equipment, and more specifically a heat exchanger, such as heat exchanger 10 for example, having a capacity between about 1 ton and about 5 tons. Accordingly, a heat exchanger 10 suitable for use in such evaporator applications typically includes between 45 and 52 heat exchanger tubes 16, and more specifically between about 47 and 49 heat exchanger tubes 16. Further, it should be understood that at least a first heat exchanger tube **16*a* adjacent a first end of the heat exchanger 10 and at least a last heat exchanger tube 16*b* adjacent a second, opposite end of the heat exchanger 10, are possibly "dead" or inactive tubes that are not fluidly connected to the manifolds 12 and 14. These inactive heat exchanger tubes 16*a* and 16*b* provide structural rigidity to the heat exchanger 10. Accordingly, as used herein the term "dead" or inactive is intended to describe heat exchanger tubes 16*a* and 16*b* that do not form part of the refrigerant flow path of the heat exchanger 10, i.e. refrigerant does not flow through these tubes. Alternatively, in place of the one or more inactive heat exchanger tubes 16*a*, 16*b*, the heat exchanger 10 may include one or more tube sheets, which may provide a mechanism for mounting the heat exchanger within a cabinet in a robust manner. Further, a flow rate of the refrigerant through the heat exchanger 10** may be between about 200 lb/hr and about 900 lb/hr.

With reference now to FIGS. 2-5, various examples of a distributor 30 are provided in more detail. As shown, the distributor 30 includes a tubular body 32 having a first end 34, a second end 36, and a uniform, generally circular cross-section over its length. A fluid inlet 38 is arranged at the first end 34 of the tubular body 32, and an outlet 40 is formed in a sidewall 42 of the tubular body 32. In an embodiment, when the distributor is installed within the first manifold 12, the first end 34 of the distributor 30 directly abuts an inlet end of the manifold 12, so that the refrigerant flows through the inlet of the manifold 12 directly to the inlet 38 of the distributor 30.

As shown, the outlet 40 of the distributor 30 includes a plurality of orifices 44 formed at various positions over the length of the tubular body 32. The term "orifice" as used herein is intended to include openings, apertures, or holes formed in the tubular body 32 to connect a hollow interior 46 of the tubular body 32 with a portion of the hollow interior chamber 20 of the manifold 12 surrounding an exterior of the tubular body 32.

Figure 4:
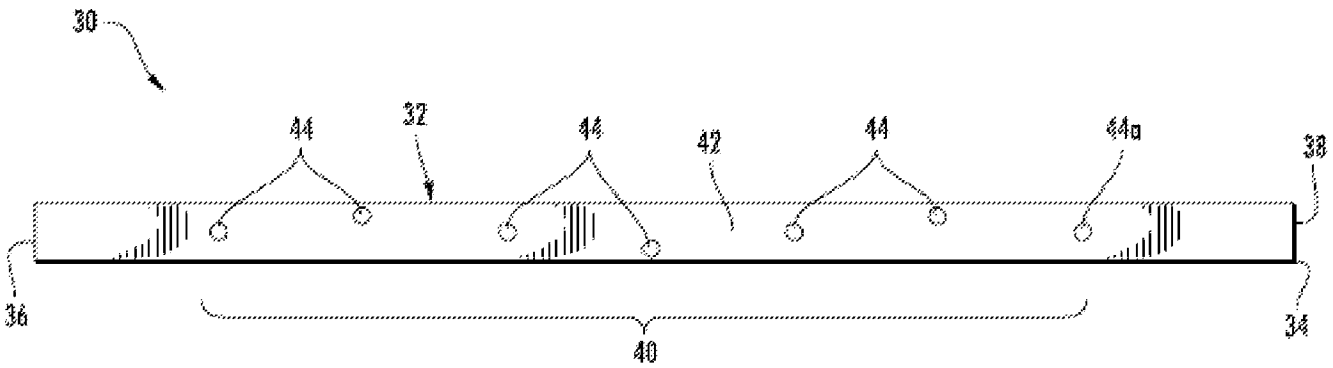
FIG. 4 is a plan view of a distributor for use in a heat exchanger according to an embodiment.
Figure 5:
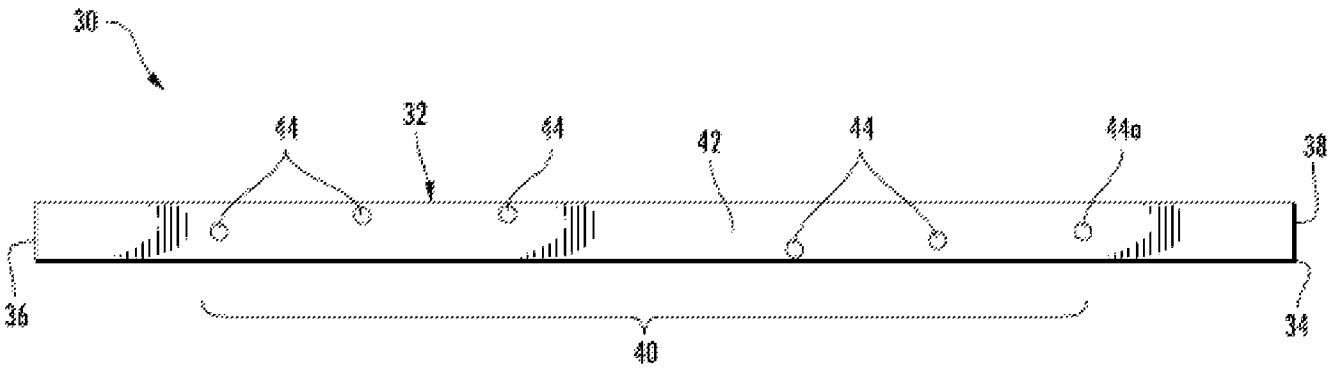
FIG. 5 is a plan view of a distributor for use in a heat exchanger according to an embodiment.

In the illustrated, non-limiting embodiment of FIG. 4, the one or more orifices 44 are arranged in a non-linear configuration. For example, as best shown in FIGS. 5-6, adjacent orifices 44 formed over the length of the distributor 30 may be arranged at various radial positions such that a relative angle exists between adjacent orifices 44. As a result, the orifices 44 may be skewed relative to a central axis defined by the tubular body 32.

As shown, adjacent orifices 44 may be offset from one another by a substantially identical angle. A first orifice is arranged at a first radial position, and a second, adjacent orifice is rotated about the periphery of the tubular body, by for example 15 degrees, to a second radial position. A third orifice of the plurality of orifices is located at a third radial position and the fourth orifice is rotated about the periphery of the tubular body, by for example 15 degrees to a fourth radial position. In an embodiment, every other orifice, for example the first and third orifices as described herein may be arranged at the same radial position relative to the tubular body 32. Additionally, although the second and fourth orifices 44 are shown as being skewed in opposite directions relative to the radial position of the first and third orifices, embodiments where the second and fourth orifices are skewed in the same direction are also within the scope of the disclosure. In addition, although an example of a 15 degree skew is suggested, any angle between adjacent orifices, such as between 5 degrees and 45 degrees, and more specifically between 10 degrees and 35 degrees, is within the scope of the disclosure. Further, embodiments where multiple orifices 44 extend in the same first radial direction relative to the central axis upstream from multiple orifices 44 extending in a second direction are also contemplated herein.

With reference to FIG. 5, in another embodiment, adjacent orifices 44 may be skewed continuously in the same direction about the entire periphery of the tubular body 32. As a result, the orifices 44 will have a cork-screw like orientation that wraps about at least a portion of the tubular body 32, or in some embodiments that wraps 360 degrees about the tubular body 32 one or more times.

One or more parameters of the distributor 30 may remain constant regardless of the configuration of either the heat exchanger 10 or residential HVAC&R system in which the distributor 30 is to be used. For example, at least one of the diameter of the distributor 30 and the length of the distributor 30 remains constant regardless of the configuration of the HVAC&R system. In an embodiment, the inner diameter of the distributor 30 is less than ½ inch, such as ⅜ inch for example. Further, the axial length of the distributor 30, extending between the first end 34 and the second end 36, is generally equal to or less than the length of the fluid distribution manifold 12 in which the distributor 30 is to be mounted. In an embodiment, the length of the distributor is generally between about 16 inches and about 20 inches.

In addition, each of the plurality of orifices 44 formed in the sidewall 42 to define the outlet 40 of the distributor 30 is generally uniform in size and shape. As used herein the phrase "generally uniform in size and shape" is intended to described embodiments where each of the orifices 44 has the same size hole diameter and same geometric shape. Accordingly, the orifices may be formed using a single die, punch, or other manufacturing instrument such that any variation between "uniform" orifices is within the range of allowable tolerances based on such a manufacturing operation. In an embodiment, each orifice 44 includes a circular opening having a diameter between about 1.2 mm and about 1.4 mm. However, embodiments where the diameter is less than 1.2 mm and/or greater than 1.4 mm are also within the scope of the disclosure.

One or more parameters of the distributor 30 may be optimized based on the configuration of the HVAC&R system, and more specifically, based on the configuration of the heat exchanger 10, to minimize the maldistribution of the refrigerant provided to the fluid distribution manifold 12. For example, the total number of orifices 44 that define the outlet 40 of the distributor 30 and the spacing between the orifices 44 may vary based on the application and capacity range of the specific HVAC&R system. In an embodiment, the total number of orifices 44 is between 4 and 15. By forming the distributor 30 with at least 4 and with no more than 15 orifices 44, the distributor 30 has the granularity necessary to distribute the liquid refrigerant among the heat exchanger tubes 16.

The total number of orifices 44 that define the outlet 40 and the spacing thereof may be determined, at least in part, based on a ratio of the pressure drop of the distributor 30 to the pressure drop of the heat exchanger 10. In an embodiment, the total number of orifices 44, the orifice diameter and spacing between said orifices are selected to achieve a distributor refrigerant pressure drop about 3-7 times the refrigerant pressure drop of the heat exchanger 10, and in some embodiments 3-5 times the refrigerant pressure drop of the heat exchanger 10 at nominal refrigerant flowrate conditions for the Residential HVAC&R system. Nominal flowrate conditions are generally accepted at the test condition where an HVAC&R system is rated for cooling or heating capacity. The pressure drop of the distributor 30 may be determined by taking the difference between a pressure reading at the inlet of the fluid distribution manifold 12 and a pressure reading at the outlet of the distributor 30. Similarly, the pressure drop of the heat exchanger 10 may be determined by taking the difference between the pressure reading at the outlet of the distributor 30 and a pressure reading adjacent an outlet of the fluid collection manifold 14, or alternatively, directly downstream from the heat exchanger 10. The pressure readings at each of the identified locations may be determined via calculations, modeling, or alternatively, via one or more sensors (not shown).

The spacing between adjacent orifices 44 of the plurality of orifices is generally constant. The first orifice **44*a* of the plurality of orifices 44, located closest to the inlet 38 of the tubular body 32 is typically offset from the first end 34 of the tubular body 32. In an embodiment, the first orifice 44*a* is located in alignment with one of the active heat exchange tubes 16. For example, the first orifice 44*a* may be aligned with any of the second, third, or fourth active heat exchanger tubes 16. However, embodiments, where the first orifice 44*a* is aligned with the first active heat exchanger tube 16 is also contemplated herein. Once a total number of orifices 44 is selected to achieve a desired ratio of the pressure drop of the distributor 30 to the pressure drop of the heat exchanger 10, the spacing between the plurality of orifices 44 may be determined in view of the position of the first orifice 44***a*.

Once the total number of orifices 44 and the corresponding position of each orifice 44 relative to the tubular body 32, the temperature of the fluid flow through the distributor 30 may be viewed. However, due to the difficulty in accurately modeling a two phase refrigerant flow through the distributor, the performance of the distributor is most effectively evaluated by building and testing the distributor within the heat exchanger. During operation of the heat exchanger, thermal images of the fluid flow through the heat exchanger, and in particular, through the orifices of the distributor into the adjacent heat exchanger tubes 16 are taken. These thermal images may be used to assess the temperature gradient across the outlet portion of the heat exchanger 10, by viewing the fluid collection manifold 14, and therefore identify which of the orifices 44, if any, do not receive a uniform distribution of two-phase refrigerant. The overall design of the distributor 30 may then be further optimized to eliminate any of the orifices 44 where a reduced flow is exhibited in a particular section of the heat exchanger 10. In embodiments where one or more orifices 44 of a distributor 30 are determined to have a reduced flow, the one or more orifices 44 are typically located along the second half of the tubular body 32, such as between a mid-point and ¾ of the length of the distributor 30 for example.

Inclusion of a distributor 30 having a design as illustrated and described herein provides enhanced distribution to a plurality of heat exchanger tubes 16 of a heat exchanger 10. Further, by maintaining one or more of the parameters of the distributor constant, regardless of the capacity of the heat exchanger, the commonality between various distributors eases the manufacturability of the distributors.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A distributor for use in a heat exchanger comprising:

a distributor body having a first end, a second end, and a hollow interior;

a fluid inlet formed at the first end; and a fluid outlet comprising a plurality of orifices formed in the distributor body at a plurality of axial locations along the distributor body, wherein a single orifice of the plurality of orifices is arranged at each of the plurality of axial locations, the plurality of orifices including a first orifice arranged at a first axial location, a second orifice arranged at a second axial location, a third orifice arranged at a third axial location and a fourth orifice arranged at a fourth axial location, wherein every other orifice of the plurality of orifices, including the first orifice and the third orifice, is arranged at a first radial position, the second orifice is arranged at a second radial position, the second radial position being skewed relative to the first radial position in a first direction, and the fourth orifice is arranged at a third radial position, the third radial position being skewed relative to the first radial position in a second direction, opposite the first direction, the fluid outlet being configured to achieve a ratio of a pressure drop across the distributor to a pressure drop across the heat exchanger between about 3 and about 7 at nominal refrigerant flowrate conditions.

2. The distributor of claim 1, wherein the ratio of a pressure drop across the distributor to a pressure drop across the heat exchanger is between about 3 and about 5.

3. The distributor of claim 1, wherein the distributor body is generally tubular in shape and has a uniform, generally circular cross-section over its length.

4. The distributor of claim 1, wherein an axial length of the distributor body is between about 16 inches and 20 inches.

5. The distributor of claim 1, wherein an inner diameter of the tubular body is less than ½ inch.

6. The distributor of claim 1, wherein each of the plurality of orifices is uniform in size and shape.

7. The distributor of claim 1, wherein a diameter of each of the plurality of orifices is between 1.2 mm and 1.4 mm.

8. A method of designing a distributor for a heat exchanger of a residential heating ventilation and air conditioning system comprising:

determining a number of orifices to form in a distributor body to achieve a ratio of a pressure drop across the distributor to a pressure drop across the heat exchanger between about 3 and about 7 at nominal refrigerant flowrate conditions;

determining a spacing between the orifices, a first orifice being positioned in alignment with an active tube of the heat exchanger;

collecting thermal images of a fluid flow through the heat exchanger when a distributor having the determined number of orifices and the determined spacing between the orifices is associated with a liquid distribution manifold of the heat exchanger;

identifying which, if any of the orifices, do not receive a uniform distribution of two-phase refrigerant; and eliminating the identified orifices from the outlet portion of the heat exchanger.

* * * * *